United States Patent [19]

Stein

[11] 4,201,996

[45] May 6, 1980

[54] CATHODE RAY TUBE HAVING IMAGE TRANSFER MEANS

[75] Inventor: William W. Stein, Beaverton, Oreg.

[73] Assignee: Tektronix, Inc., Beaverton, Oreg.

[21] Appl. No.: 948,724

[22] Filed: Oct. 5, 1978

[51] Int. Cl.[2] ..... H04N 5/80

[52] U.S. Cl. ..... 346/158; 346/161

[58] Field of Search ..... 346/160, 161, 158, 159

[56] References Cited

U.S. PATENT DOCUMENTS

| | | | |
|---|---|---|---|
| 3,242,261 | 3/1966 | MacGriff | 346/158 |
| 3,277,237 | 10/1966 | Wolfgang | 346/160 |
| 3,278,683 | 10/1966 | Ashby | 346/158 |
| 3,368,106 | 2/1968 | Berthold | 346/160 |
| 3,424,862 | 1/1969 | Berthold | 346/161 |
| 3,681,777 | 8/1972 | Smura | 346/161 |
| 3,704,468 | 11/1971 | Ohta | 346/161 |
| 3,786,182 | 1/1974 | Kaneko | 346/161 |

*Primary Examiner*—John H. Wolff

*Attorney, Agent, or Firm*—Adrian J. LaRue

[57] ABSTRACT

A cathode ray tube is provided with a faceplate having a phosphor screen for visibily displaying information thereon and is also formed with an image transfer means along an edge of the faceplate. When it is desired to record the visibly displayed information from the phosphor screen, the information is scrolled along the image transfer means which transfers the image to a recording medium whereon the image is recorded.

4 Claims, 4 Drawing Figures

CATHODE RAY TUBE HAVING IMAGE TRANSFER MEANS

BACKGROUND OF THE INVENTION

The present invention relates to recording systems and more particularly to recording systems wherein a visual image of information is displayed on the screen of a cathode ray tube, and, if it is desired to record the visually displayed information, it is transferred onto a recording medium via image transfer means.

Heretofore, when it was desired to record visually displayed information from a cathode ray tube screen, the information was photographed. There are several disadvantages to photographing desired visually displayed information and these are: Cost is a factor. The camera covers the information while it is being photographed. The camera is cumbersome. It is difficult to record written information on the photograph.

U.S. Pat. No. 3,027,219 to Bradley is directed to a cathode ray tube which is provided with a series of light-conducting elements disposed adjacent the faceplate of a cathode ray tube. Ends of the light-conducting elements are positioned adjacent a film so that information written into the screen of the faceplate by the electron beam will be transferred via the light-conducting elements to the film for recording thereon. The information however cannot be viewed before recording so that no selection of the information can be made.

U.S. Pat. No. 3,368,106 to Berthold covers a faceplate of a cathode ray tube which has a photoconductive layer on a fiber optic member with electrodes along opposite edges of the photoconductive layer. Current flows through the electrodes that engage a dielectric recording medium as a function of the beam current engaging the phosphor target on the fiber optic member to transfer charges to the recording medium. No visual display of information is provided by the tube of Berthold as it is a printing tube.

Boon in U.S. Pat. No. 3,663,748 discloses a flying spot scanning cathode ray tube for reading out information line by line from a document which is reproduced on a recording medium by transferring the information via a wire array onto a recording medium. Thus, the electron beam is shared to write information and then to read the written information and visual presentation of written information is not possible in order to select what written information is to be recorded.

A thermal recording cathode ray tube is taught by U.S. Pat. No. 3,764,839 to Fujimura wherein electron beam current is used to operate an array of heat resistive members on the faceplate of the cathode ray tube so that the heat sensitive paper passing in engagement with the heat resistive members will thermally record the information being written by the electron beam onto the array of heat resistive members. No visual display of the information and subsequent recording of selected visually-displayed information is provided by Fujimura.

In U.S. Pat. No. 3,789,259 to Allen, a cathode ray tube visually displays information via its electron beam on its phosphor screen and then directing the electron beam onto an image transfer means in the funnel section of the tube or in the faceplate to record the visually displayed information as desired. Positioning the image transfer means in the funnel section or in the faceplate makes it difficult and costly to manufacture a cathode ray tube of this type.

SUMMARY OF THE INVENTION

In accordance with the present invention, an improved cathode ray tube is provided with an image transfer means as part of the phosphor screen to enable visually displayed information to be selectively moved along the image transfer means so that the information is recorded onto a dielectric medium that is moved in engagement with the image transfer means.

It is therefore an object of the present invention to provide an improved cathode ray tube that visually displays information and an image transfer means that enables selectively recording the visually displayed information.

Another object of the present invention is the provision of a cathode ray tube wherein an image transfer means is part of the viewing means.

A further object of the present invention is to provide an image transfer means as part of the viewing means of a cathode ray tube for selectively transferring visually displayed information on the viewing means to a recording medium.

An additional object of the present invention is the provision of an image transfer means in the form of a fiber optic array that is secured along an edge of a cathode ray tube faceplate in operative engagement with a portion of a phosphor screen on the faceplate.

Still another object of the present invention is to provide the image transfer means with a transparent conductive coating on the fiber optic array and a coating of photoconductive material on the conductive coating.

BRIEF DESCRIPTION OF THE DRAWINGS

Other features and advantages of the present invention will become apparent upon consideration of the following detailed description taken in consideration with the accompanying drawings wherein.

DETAILED DESCRIPTION OF THE INVENTION

Figure 1:
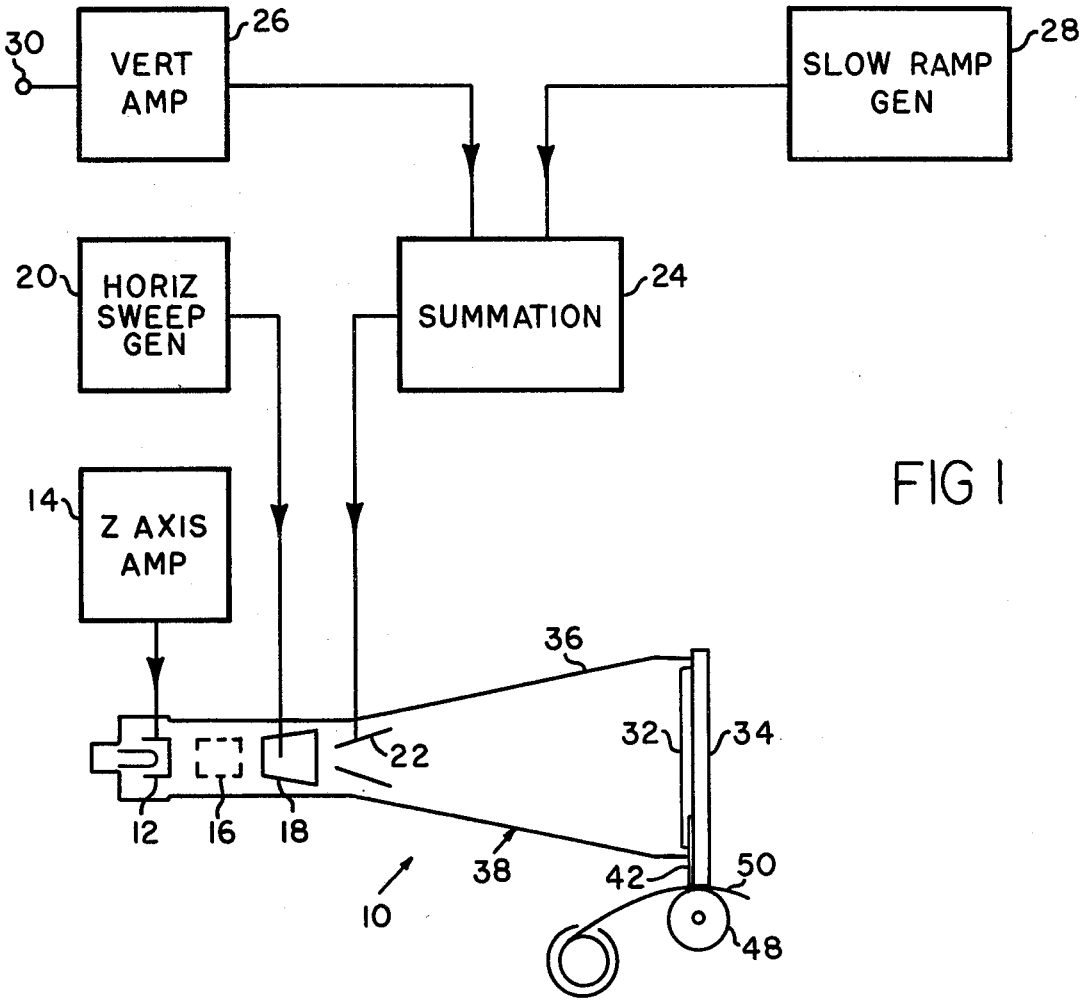
FIG. 1 is a diagrammatic view of a recording system utilizing a cathode ray tube.

A cathode ray tube 10 is provided with a conventional electron gun including a cathode 12 that is connected to Z-axis voltage source 14, an electrostatic lens structure 16 of conventional design which operates to form a narrow beam of electrons emitted from the cathode. A pair of horizontal deflection plates 18 is connected to a horizontal sweep generator 20 and a pair of vertical deflection plates 22 is connected to a summation circuit 24 which has a vertical amplifier circuit 26 and slow ramp generator circuit 28 connected thereto. Horizontal sweep generator 20, summation circuit 24, vertical amplifier circuit 26 and slow ramp generator 28 are conventional circuits. An input terminal 30 is connected to vertical amplifier 26.

Figure 2:
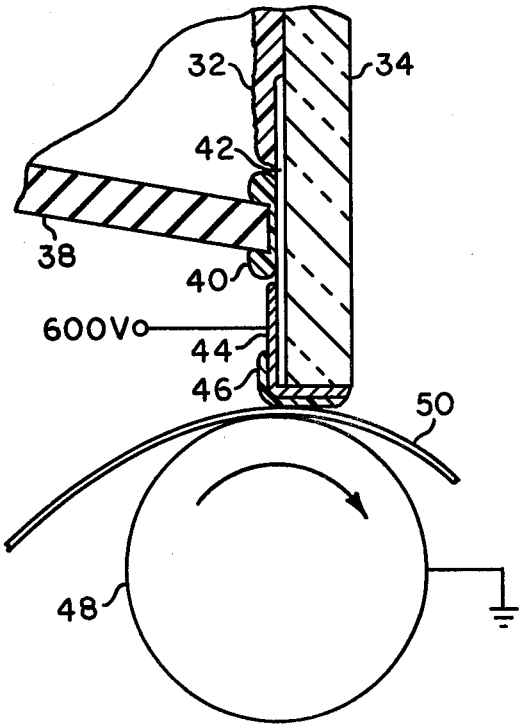
FIG. 2 is a cross-sectional view on an enlarged scale taken along line 2—2 of FIG. 1.
Figure 4:
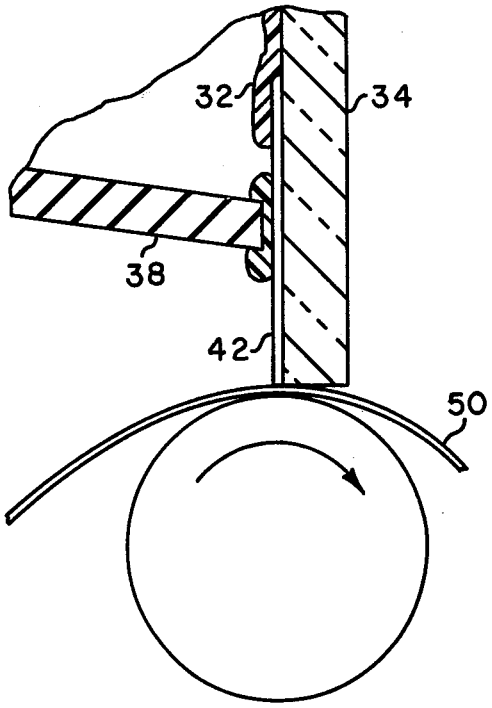
FIG. 4 is a view similar to FIG. 2 of an alternative embodiment.

Phosphor screen 32 is located on faceplate 34 which is sealingly secured to funnel section 36 of the tube envelope 38 via frit seal 40 (FIGS. 2 and 4). A fiber optic array 42 is frit sealed to the inner inside surface of faceplate 34. As shown in FIG. 2 a first section of fiber optic array 42 is located under a portion of phosphor screen 32 inside the tube envelope and a second section extends through frit seal 42 to the edge of faceplate 34. The fiber optic array 42 is of conventional construction and includes bundles of fiber optic members for transmitting light information.

A thin coating 44 of transparent conductive material, such as tin oxide, is applied onto fiber optic array 42 and along the edge of faceplate 34, and a layer 46 of photoconductive material, such as cadmium sulfide or the like, covers a portion of conductive coating 44 along fiber optic array 42 and along coating 44 that extends along the faceplate edge. Conductive coating 44 is connected to 600 volts. A conductive roller 48 is connected to ground and it presses dielectric medium 50 against photoconductive layer 46 as it is being moved therealong via a feed mechanism of conventional design as disclosed in U.S. Pat. No. 3,679,824 in correspondence with the movement of the electron beam along the phosphor-covered fiber optic array. Dielectric medium 50 is moved in correspondence with the movement of the electron beam and accepts the latent electrostatic image and is subsequently toned and fixed in the conventional way.

The embodiment of FIG. 4 is the same as that of FIG. 2 except that no conductive coating 44 or photoconductive layer 46 is provided on fiber optic array 42 so that fiber optic array 42 transfers visually displayed information to a dry silver paper that is commercially available from Minnesota Mining and Manufacturing Company that is identified as 3M Type 7772 Dry Silver Paper or 3M Type 7869 Dry Silver Film and each is developed by the application of heat. The image transfer means of FIG. 2 comprises fiber optic array 42, conductive coating 44 and photoconductive layer 46 whereas it is fiber optic array 42 in FIG. 4.

Figure 3:
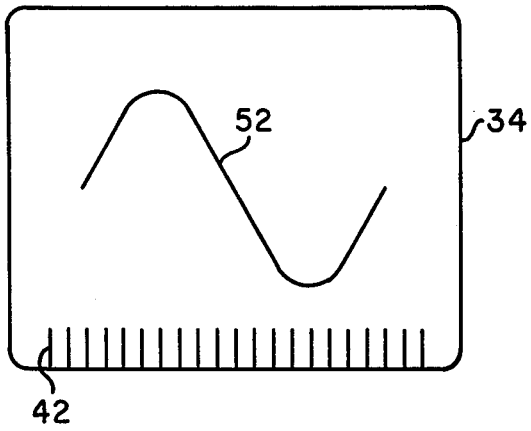
FIG. 3 is a representation of the front view of the faceplate of the cathode ray tube.

The operation of the invention is as follows:

When an input signal is applied to input terminal 30 of vertical amplifier 26, the amplified signal is applied to the vertical deflection plates 22 through summation circuit 24. The input signal may also be employed to trigger the horizontal sweep generator so that the electron beam emitted by cathode 12 under control of Z axis voltage source 14 is deflected horizontally by horizontal deflection plates 18 and vertically by vertical deflection plates 22 to produce a visual image of the input signal on phosphor screen 32. Such a signal could be waveform 52 as illustrated in FIG. 3 or any alphanumeric and/or graphic information.

If it is decided the visually displayed information is to be recorded, slow ramp generator 28 is operated to generate a ramp signal that is added in summation circuit 24 to the signal information from vertical amplifer 26 which causes vertical deflection plates 22 to scroll the information along the phosphor-covered inner end of fiber optic array 42 in accordance with the ramp signal. Recording medium 50 is also moved along the edge of faceplate 34 and in engagement with the image transfer means in coincidence with the ramp signal so that the information is recorded onto the recording medium and therefore developed.

When the electron beam is scrolled along the phosphor-coated fiber optic array in FIG. 2, light from the phosphor created by the electron beam will be picked up by the fiber optic array and this light that is transmitted along the fiber optic array will cause the voltage between the conductive coating 44 and conductive roller 48 to vary in accordance with the light intensity and this will determine the amount of charge that is placed on recording medium 50 to provide a latent image of the information thereon which is subsequently toned and fixed in a conventional manner. In the case of FIG. 4, light from the fiber optic array, as a result of the electron beam scrolled along the phosphor-coated fiber optic array, sensitizes the recording medium to form thereon a latent image which is subsequently developed via heat.

It is also possible to xerographically reproduce the selected visually displayed information via conventional xerographic means if it is is desired to record the information in this manner.

Whereas, the displayed information is scrolled along the bottom edge of the faceplate, the displayed information can be scrolled along any edge of the faceplate whereon the image transfer means is provided.

The invention has been described in detail with particular reference to preferred embodiments thereof, but it is to be understood that variations and modifications can be made within the spirit and scope of the invention.

The invention claimed in accordance with the following:

1. A display and recording system comprising:

a cathode ray tube including an electron gun for generating a writing beam of electrons, deflection means for deflecting said writing beam in accordance with input signals that are applied thereto, and a faceplate having a phosphor screen thereon for visually displaying information thereon corresponding to the deflection thereon of said writing beam by said deflection means;

image transfer means disposed along said faceplate, said image transfer means defining a first section and a second section, said first section located inside said cathode ray tube and having a portion covered by a part of said phosphor screen, said second section extending along an edge of said faceplate outside said cathode ray tube and remote from said visual display;

recording means for passage along and in engagement with said second section of said image transfer means; and means operatively connected to said deflection means for selectively deflecting said writing beam along said part of said phosphor screen to scroll the visually displayed image line by line along said part and transfer the line by line image via said image transfer means to provide a permanent said recording means to record of the visually displayed information thereon.

2. A recording system according to claim 1 wherein said image transfer means comprises fiber optic array means.

3. A recording system acccrding to claim 1 wherein said image transfer means comprises fiber optic array means having a transparent coating extending along said second section of said fiber optic array means and along an edge of said faceplate, and photoconductive layer means extending along said conductive coating.

4. A recording system according to claim 1 wherein said means operatively connected to said deflection means comprises slow ramp generator means for generating a ramp signal and summation circuit means, said summation circuit means adding said input signals from a vertical amplifier of said deflection means and said ramp signal to scroll the visually displayed image line by line along said part.

* * * * *